United States Patent [19]

Nobue et al.

[11] Patent Number: 4,891,557

[45] Date of Patent: Jan. 2, 1990

[54] MAGNETRON DEVICE

[75] Inventors: Tomotaka Nobue, Yamatokoriyama; Tomohide Matsumoto, Yamatotakada; Tadashi Hikino, Ikoma, all of Japan

[73] Assignee: Matsushita Electric Industrial Co., Ltd., Osaka, Japan

[21] Appl. No.: 109,024

[22] Filed: Oct. 16, 1987

[30] Foreign Application Priority Data

Oct. 16, 1986 [JP] Japan ..... 61-245743

[51] Int. Cl.[4] ..... H01J 25/50

[52] U.S. Cl. ..... 315/39.51; 315/39.69; 315/39.53; 315/39.77; 315/39.55

[58] Field of Search ..... 315/39.51, 39.69, 39.53, 315/39.55, 39.63, 39.77

[56] References Cited

U.S. PATENT DOCUMENTS

| | | | |
|---|---|---|---|
| 3,553,524 | 1/1969 | Hill | 315/39.69 |
| 4,056,756 | 11/1977 | Derby | 315/39.51 |
| 4,179,639 | 12/1979 | Derby | 315/39.69 |
| 4,287,451 | 9/1981 | Koinuma et al. | 315/39.69 |
| 4,310,786 | 1/1982 | Kumpfer | 315/39.51 |
| 4,644,225 | 2/1987 | Aiga et al. | 315/39.51 |
| 4,705,989 | 11/1987 | Takada et al. | 313/341 |
| 4,720,659 | 1/1988 | Aiga et al. | 315/39.69 |
| 4,742,272 | 5/1988 | Kusano et al. | 315/39.69 |

*Primary Examiner*—Leo H. Boudreau
*Assistant Examiner*—Michael Razavi
*Attorney, Agent, or Firm*—Wenderoth, Lind & Ponack

[57] ABSTRACT

A magnetron device includes an anode cylinder incorporated with multi-resonant cavities, an output antenna arranged in a direction normal to the axis of the anode cylinder, a set of strap rings arranged through holes in vanes, an antenna lead having one end directly connected to the strap ring, and its other end connected to the output antenna, and an exhaust pipe provided at one end of the anode cylinder. Accordingly the magnetron device operates with high efficiency, is compact and produces a relatively low level of noise.

4 Claims, 5 Drawing Sheets

High frequency field distribution

High frequency field distribution

MAGNETRON DEVICE

BACKGROUND OF THE INVENTION

The present invention generally relates to a magnetron device and more particularly, to an improved magnetron to be incorporated in a high frequency microwave oven i.e. so-called electronic range or the like (referred to as an electronic range hereinafter).

In the field of electronic ranges which are coming into wide use in recent years, technical improvements have been continuously made in order to achieve the targets and satisfy the requirements both in the demand and supply with respect to compact size, light weight and reduction in cost, and under the above circumstances, reduction in size and weight, high operating efficiency, low noise and reduction of cost, etc. are also required for the magnetron to be incorporated in such electronic range.

With respect to the compact size and light weight which are of the first subject, improvement of a magnetic circuit is first brought into consideration.

In the magnetron commonly used, a ferrite magnet has been generally employed, and it was considered to replace the material for the magnet by Alnico (name used in trade and manufactured by General Electric Co., U.S.A.) or a samarium-cobalt (Sm-Co)alloy for reduction of size and weight of the magnetic circuit. However, such magnet material could not take the place of the ferrite magnet due to a strong market tendency towards the low cost.

For other means to achieve the above first subject through employment of the ferrite magnet, there may be considered an improvement of a magnetron output structure. More specifically, in the magnetron for common use, although the output antenna is arranged in the axial direction of an anode cylinder, it is intended, in the improved structure, to dispose the output antenna in a direction normal or perpendicular to the axis of the anode cylinder. The advantage of the above structure is such that the structural dimension of the magnetron main body with respect to the longitudinal direction of its output antenna can be reduced, whereby compact size of the electronic range on the whole may be achieved.

With respect to the high operating efficiency which is the second subject for the improvement, owing to the fact that this efficiency is to be determined by the product of electronic efficiency, which is a conversion factor for converting kinetic energy of electrons emitted from a cathode into high frequency energy, and circuit efficiency, which is a deriving factor for deriving the high frequency energy produced in a resonance circuit of an anode out of the anode, such improvement of the operating efficiency may be ascribed to enhancement of the electronic efficiency or circuit efficiency.

As means for enhancing the electronic efficiency, there may be considered optimization of a relative design of the cathode portion diameter and the inner diameter of the anode surrounding the cathode portion with respect to the number of resonance cavities of the anode resonance circuit can be considered namely, optimization of an interaction space, uniform distribution of magnetic field within said interaction space, and optimization of the high frequency field into the interaction space, and even more particularly optimization of the high frequency field action with respect to electrons.

Of the above-described considerations, with respect to the former two various studies have been made in which a technique therefor has almost been established. By way of example, for the optimization of the interaction space, the ratio of the cathode radius $r_c$ to the anode inner radius $r_a$ is designed to satisfy the relation represented by $$\frac{r_c}{r_a} \approx \frac{N-4}{N+4}$$

with respect to the number of resonance cavities N in order to achieve a stable $\pi$ mode oscillation. Meanwhile, with respect to the uniformity of the magnetic field distribution, this is dealt with by devising configurations of pole pieces disposed at opposite ends in the axial direction of the interaction space.

However, concerning the optimization of the high frequency field action with respect to electrons, there has been no technique which clearly refers thereto as a structure for the means, about which, description will be given later.

On the other hand, as means for improving the circuit efficiency, there may be conceived enhancement of a value Q for the resonance circuit, i.e. reduction of loss in the resonance cavities, increase of coupling degree between a load circuit and the resonance circuit, etc.

Normally, the latter means is introduced into the resonance circuit as designed by the former means. Incidentally, noises are increased in proportion to the increase of the coupling degree, and thus, although the practice involves some inconsistency with respect to the requirement for low noise which is another subject for improvement to be described below, the optimum coupling degree has been selected while suppressing the noise within the standard.

With respect to the reduction of noise related to the third subject, most of the means employed are arranged to suppress the generated noise by a filter circuit added thereto, but there have also been considered some means adapted to suppress generation of the noise itself. By way of example, there are proposed means for suppressing noise through suppression of turbulence in the electron movement near the forward end side portions of vanes which form the resonance cavity group, by applying proper cuts in the edge in the longitudinal direction of such vane forward end side portions confronting the cathode portion, and means for suppressing noise through suppression of electron flow intending to flow out in the longitudinal direction of the cathode portion by insulating the pole pieces disposed at the opposite ends in the axial direction of the interaction space, from the anode portion.

For solving the various subjects as described so far, there has conventionally been disclosed an interesting construction, for example, in U.S. Pat. No. 4,310,786. The magnetron structure disclosed in said prior art is mainly characterized in a supporting construction of the cathode portion, in which said cathode portion is arranged to be supported by a pair of pole pieces insulated from the anode portion. As a second feature, a set of strap rings are arranged at the central portion in the axial direction of an anode cylinder within the vanes, while an output antenna is disposed in a direction normal to the axis of the anode cylinder as a third feature. Accordingly, with respect to the various subjects as described earlier, the construction of said prior art intends to achieve compact size and low noise, although the operating efficiency thereof is considered to be lower than that of the conventional magnetron due to a reason which is to be described later.

Regarding the construction of the strap rings which is the second feature of the above described prior art, there are also considered various other constructions, part of which is disclosed, for example, in U.S. Pat. No. 3,553,524. In this prior art, it is stated that the position for disposing the strap rings for stably maintaining the $\pi$ mode oscillation should preferably be within the vanes as compared with the arrangement of such strap rings at upper and lower edges of vanes as employed in the common magnetrons. Meanwhile, it is shown that the strap ring arranging construction in U.S. Pat. No. 4,310,786 referred to earlier is difficult to be applied to the commonly used magnetrons due to increase of manufacturing cost, but this point may be solved if the techniques disclosed in U.S. Pat. Nos. 4,056,756 and 4,179,639 are adopted.

In connection with the above, it is to be noted that, with respect to the effects in use of such strap rings to be arranged within the vanes, specific effects thereof have not been fully clarified up to the present.

SUMMARY OF THE INVENTION

Accordingly, an essential object of the present invention is to provide a magnetron device compact in size at high operating efficiency with a low noise, and can be readily manufactured at the same cost as in the conventional magnetron devices.

Another important object of the present invention is to provide a magnetron device of the above-described type, which is provided, inside its vanes, with improved strap rings having predetermined effects on the reduction of noise.

A further object of the present invention is to provide a magnetron device of the above-described type, which is provided with an improved output structure having an output antenna disposed normal to the axis of an anode cylinder.

Still another object of the present invention is to provide a magnetron device which is so designed that the above improved output structure may be manufactured with a high degree of accuracy.

In accomplishing these and other objects, according to one preferred embodiment of the present invention, there is provided a magnetron device which includes an anode cylinder, a plurality of vanes radially arranged within the anode cylinder, a set of strap rings having different diameters, arranged through holes in the vanes so as to be alternately connected to the vanes, an output antenna portion extending in a direction normal to an axis of the anode cylinder, an antenna lead having one end connected to the strap ring, and the other end thereof extending through a coupling hole formed in a side wall of the anode cylinder so as to be held and fixed within the output antenna portion for example, by brazing, and an exhaust pipe provided on one end face of the anode cylinder for facilitating the evacuation of the interior of said anode cylinder.

Due to the above-described structure of the present invention, a compact magnetron device having a high operating efficiency and producing only a low level of noise can be advantageously fabricated at a low cost.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE PREFERRED EMBODIMENTS

Figure 1:
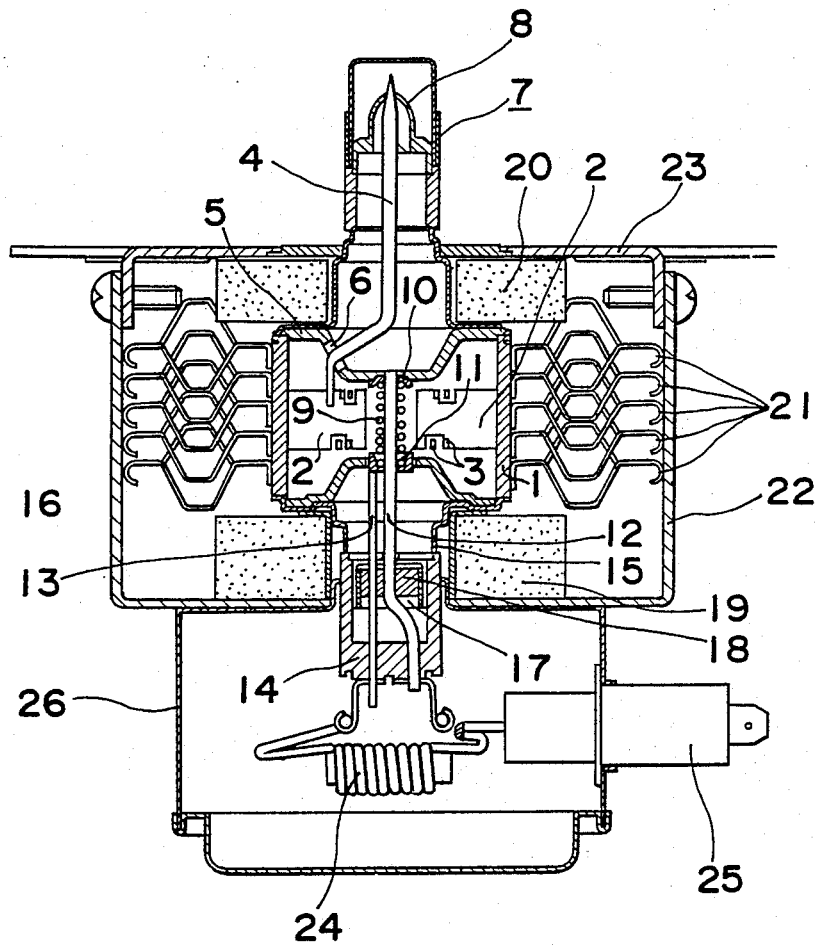
Fig. 1 PRIOR ART
FIG. 1 is a sectional side view showing the general structure of one example of a conventional magnetron device.

Before the description of the present invention proceeds, it is to be noted that like parts are designated by like reference numerals throughout the accompanying drawings.

Referring now to the drawings, there is shown in FIG. 1, the general structure of one example of a conventional magnetron device.

The known magnetron device of FIG. 1 generally includes an anode cylinder 1, a plurality of vanes 2 disposed within said anode cylinder 1, two sets of strap rings 3 provided at opposite ends of the vanes 2 in an axial direction of said anode cylinder 1, and each alternately connected to every other vane of said plurality of vanes 2, and an antenna lead 4 having one end connected to one of the vanes 2 at a desired location, and the other end thereof extending to an antenna portion 7 disposed in the axial direction of the anode cylinder 1 through a coupling hole 6 of a pole piece 5 provided at the end of the anode cylinder 1. This antenna lead 4 is cut off simultaneously with an exhaust pipe 8 which serves as an exhaust passage when the interior of the anode cylinder 1 is evacuated, and is integrally connected with the exhaust pipe 8 at the cut off portion of said exhaust pipe as illustrated. The magnetron device further includes a cathode portion 9 comprising a spirally wound filament concentrically disposed within the anode cylinder 1 at the central portion of said anode cylinder, with end plates 10 and 11 provided at opposite ends of said cathode portion 9. The end plates 10 and 11 are respectively connected to support leads 12 and 13 extending in the axial direction of the anode cylinder 1, while the respective support leads 12 and 13 are connected to a cathode stem 14 comprising ceramic material and mounted in the device at the end face of the anode cylinder 1 on the side opposite to the output antenna portion 7, for example, by silver-copper alloy brazing, and this cathode stem 14 is fixed to the end face of the anode cylinder 1 through a cathode side pipe 15 connected thereto by silver-copper alloy brazing. There are also provided another pole piece 16 at the side of the cathode stem 14, a dielectric member 17 and a metallic pipe 18 for suppressing unnecessary radiation radiating toward the cathode stem 14, ferrite permanent magnets 19 and 20 disposed at the opposite end faces of said anode cylinder 1, heat radiating fins 21 forcibly fitted around the anode cylinder 1, yokes 22 and 23 constituting a magnetic circuit, a choke coil 24 with a core connected at one end to the cathode stem 14 and at the other end thereof to a capacitor 25 extending into a filter box 26, the filter box 26 covering the portion of the cathode stem 14 and the choke coil 24.

In the conventional magnetron structure as described so far, one measure taken for enhancing the output efficiency of the magnetron is to dispose the connecting position of the antenna lead 4 with the specific vane 2 towards the central portion of the anode cylinder 1 as far as practicable. However, as is clear from the construction of the conventional magnetron device as shown in FIG. 1, such a connecting position is limited by the structure, since the strap rings are disposed at the vane end portions. Moreover, since the electro-magnetic field distribution is extremely disturbed in a space in the vicinity of the portion where the strap rings are disposed as described below, the operating efficiency is undesirably lowered by the connecting structure in which the connecting position of the antenna lead to the vane is displaced towards the inner wall side of the anode cylinder 1 so as to avoid a coupling between unnecessary electro-magnetic waves and the antenna lead. In other words, the conventional magnetron device does not appear to be capable of simultaneously satisfying both requirements of high output efficiency and suppression of unnecessary radiation.

Figure 2:
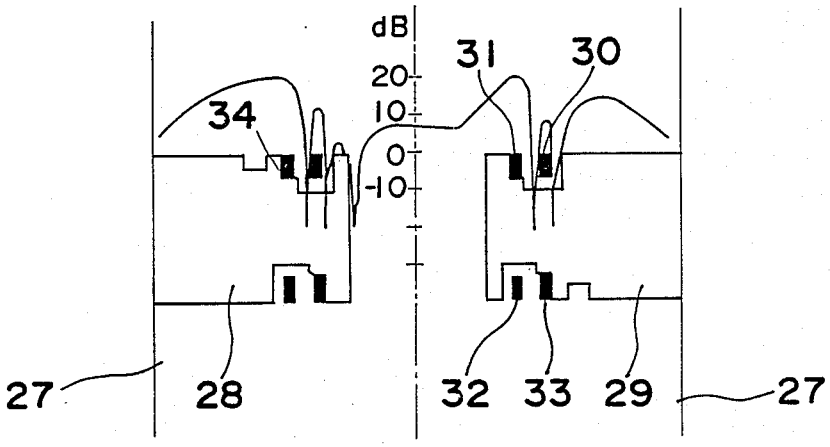
Fig. 2 PRIOR ART
FIG. 2 is a diagram showing the field distribution of high frequency electric energy in a conventional anode structure.

FIG. 2 in a diagram representing the high frequency electric field distribution at the vane side end face in the conventional magnetron as measured by the present inventors. In FIG. 2, the inner wall of the anode cylinder 1 is represented by Numeral 27, vanes confronting each other within the anode cylinder 1 are shown by Numerals 28 and 29, strap rings are denoted by Numerals 30, 31, 32 and 33, and the location at which the antenna lead is connected is to one of the vanes indicated by Numeral 34. From this diagram, it is noticed that, in the conventional structure in which the strap rings are disposed at the vane end portions, the high frequency electric field is disturbed to a large extent in the vicinity of the strap rings. Meanwhile, in a space defined between the confronting vanes and through which the cathode portion extends, it is also noticed that a certain amount of high frequency electric energy is present. This fact indicates that part of the microwave energy produced within the anode cylinder is coupled with the cathode portion, and also disturbs the movement of electrons emitted from the cathode portion, thus increasing unnecessary radiation radiating towards the cathode stem side through the cathode portion support lead.

Figure 3:
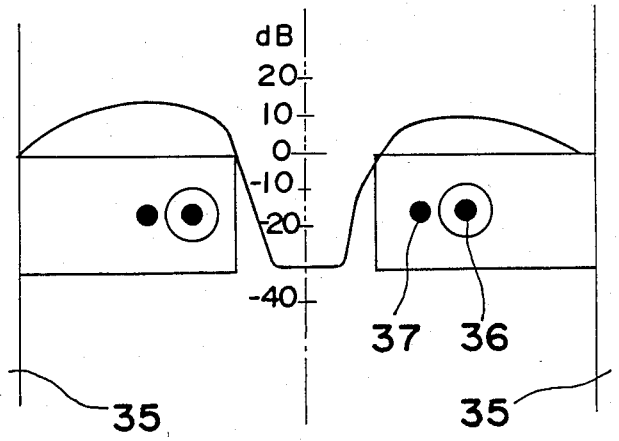
FIG. 3 is a diagram similar to FIG. 2, which particularly shows the field distribution of high frequency electric energy in an anode structure according to the present invention.

On the other hand, measurements were taken by the present inventors on the high frequency electric field distribution at the vane end portions with respect to the anode structure in which the strap rings are arranged within the vanes as disclosed in U.S. Pat. No. 4,310,786 to Beverly D. Kumpfer et al., with the result as described hereinafter. The high frequency electric field distribution characteristics obtained are shown in FIG. 3, in which Numeral 35 represents the anode cylinder inner wall, while Numerals 36 and 37 show a set of strap rings. The structure referred to above exhibits marked differences in characteristics from the conventional anode structures with respect to the following two points. The first point is that the high frequency field distribution on the vane end face is in good order, while the second point relates to the fact that since the high frequency field distribution is generally symmetrical with respect to the cylinder axis and thus, the high frequency electric field intensity is extremely low in the space located between the confronting vanes, coupling of the microwave energy with respect to the cathode portion is weak. In other words, with the employment of the anode structure as described above, movement of electrons is not readily disturbed by the microwaves, and it is considered that the suppression of the unnecessary radiation leaking through the cathode electrode will be remarkably improved.

Incidentally, the output structure disclosed in the U.S. Patent referred to above, i.e. the microwave energy deriving structure in which one end of the antenna lead is formed into a loop shape, with its forward end connected to the vane is disadvantageous in that it is difficult to enhance the efficiency of the magnetron up to the degree obtained in the conventional output deriving structure as shown in FIG. 1, and this drawback is attributable to the construction of the set of strap rings. More specifically, as is well known, to the determination of the resonance frequency of the small resonance cavity defined by the neighboring vanes and the inner side face of the anode cylinder, inductance Lr and capacitance Cr of the cavity when the presence of strap rings is neglected, and capacitance Cs generated by attaching the strap rings are related. Meanwhile, the ratio of the capacitance Cr to capacitance Cs should be properly determined from the view point of oscillation mode separating degree. In other words, in order to obtain the capacity value conventionally achieved by the two sets of strap rings, through employment of one set of strap rings, it is necessary to increase the length of the strap rings disposed within said small resonance cavity. That is to say, the strap rings is required to have a diameter larger than that in the conventional arrangement. Therefore, the connecting position of the antenna lead to the vane is undesirably shifted towards the inner wall face side of the anode cylinder to a larger extent than in the conventional arrangement, thus inviting reduction of efficiency due to lowering in the coupling degree. If it is to be intended to improve the efficiency somehow through employment of the prior technique, the antenna lead may be prolonged as one measure, but since such prolongation can only be accomplished outside the anode cylinder due to the reason described earlier; this results in a relatively long output antenna portion and consequently, it is necessary to adopt a structure that is not compact or to employ an unpractical structure.

Figure 4:
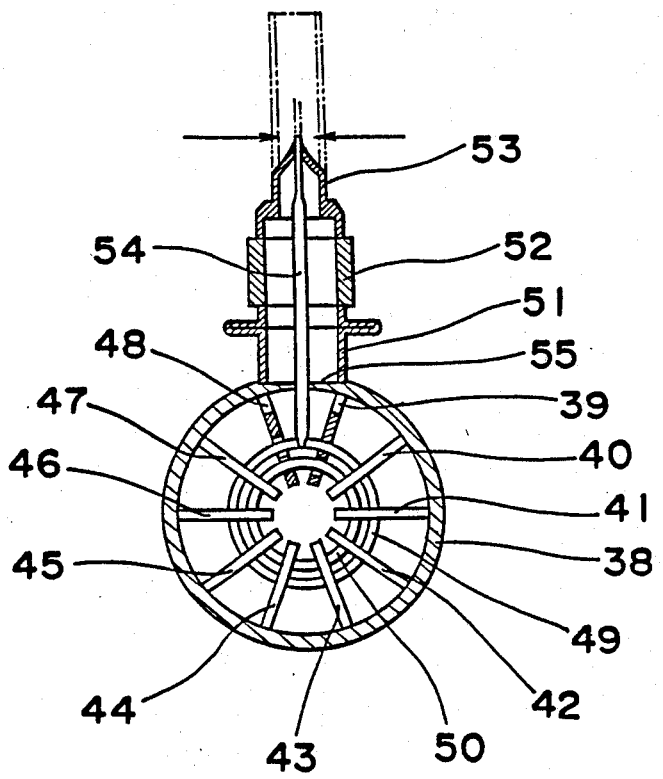
FIG. 4 is a cross section of an essential portion of a magnetron device conceived by the present inventors prior to the present invention.

For eliminating the disadvantage described above, the present inventors proposed an arrangement for directly connecting the antenna lead to the strap rings, one example of which is shown in FIG. 4.

The known magnetron device of FIG. 4 includes an anode cylinder 38, a plurality of vanes 39 to 48 radially arranged in the anode cylinder 38, a set of strap rings 49 and 50 alternately connected to every other one of said vanes, an antenna side pipe 51 extending outwardly from the anode cylinder 38 in a direction perpendicular to the axis of said anode cylinder, a ceramic side pipe 52 connected to the antenna side pipe 51, for example, by silver-copper brazing, an exhaust pipe 53 connected to the ceramic side pipe 52 also by silver-copper brazing or the like, and an antenna lead 54 concentrically disposed through a coupling hole 55 of the anode cylinder 38, the antenna side pipe 51, the ceramic side pipe 52 and the exhaust pipe 53. The antenna lead 54 is connected at one end to the strap ring 49 and is fixed, at a sealed cut portion, at its other to the exhaust pipe 53 after evacuation of the interior of the anode cylinder 38 up to a predetermined level. In FIG. 4, the portion represented by one-dot chain lines shows the exhaust pipe and antenna lead before the cutting, and is to be depressed for cutting in the directions indicated by arrows. In this case, however, there have been such inconveniences that the antenna lead 54 is pushed towards the anode cylinder 38 by the volume variation component thereof due to the depression for cutting, thus resulting in deformation of the strap ring 49 connected to the antenna lead 54 towards the central portion of the anode cylinder 38 or bending of the vane 39 connected with the strap ring toward the neighboring vane 40 by the stress during the cutting, or contact between the strap rings or vanes in the worst case, thereby hindering normal operation of the magnetron device.

As described above, upon employment of the construction in which the strap rings are provided within the vanes as the unnecessary radiation suppressing means, with the antenna lead being directly connected to the strap ring as the output efficiency enhancing means, there has been invited the problem that normal operation of the magnetron device is obstructed due to deformation of the strap rings and vanes in the cutting and sealing process of the exhaust pipe having the antenna lead provided inside.

Figure 5:
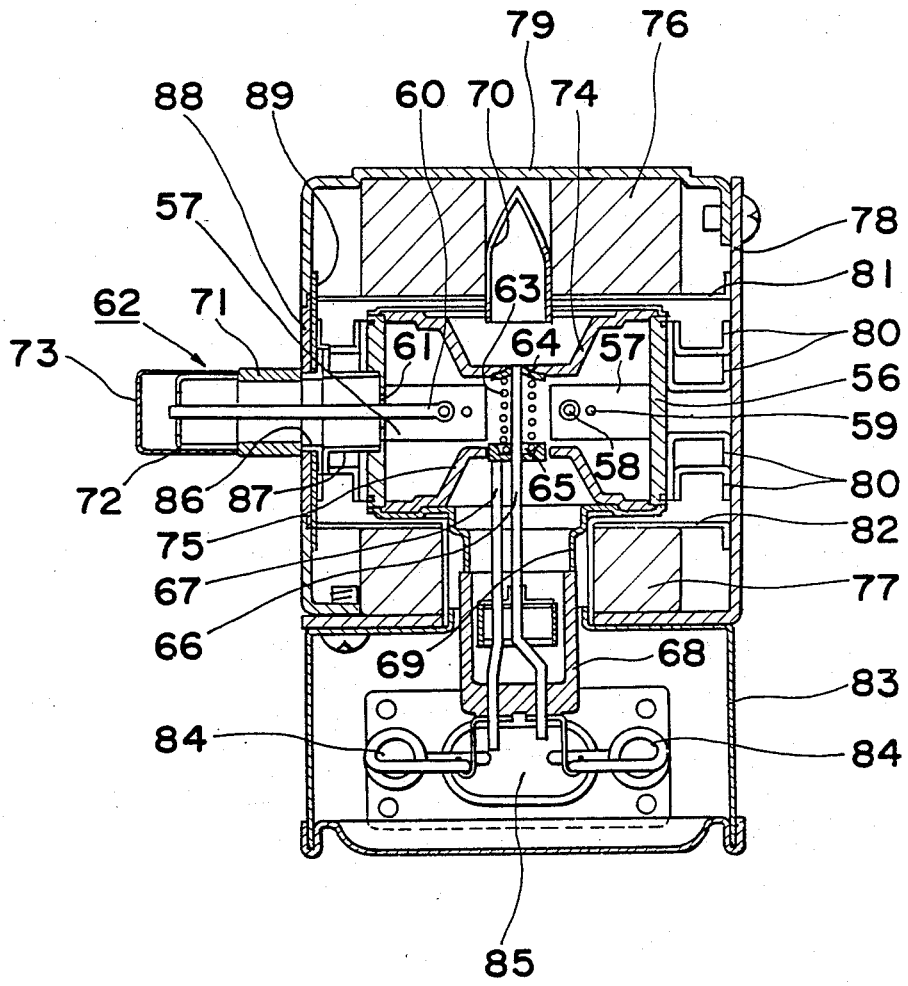
FIG. 5 is a sectional side view of a magnetron device according to one preferred embodiment of the present invention.
Figure 6:
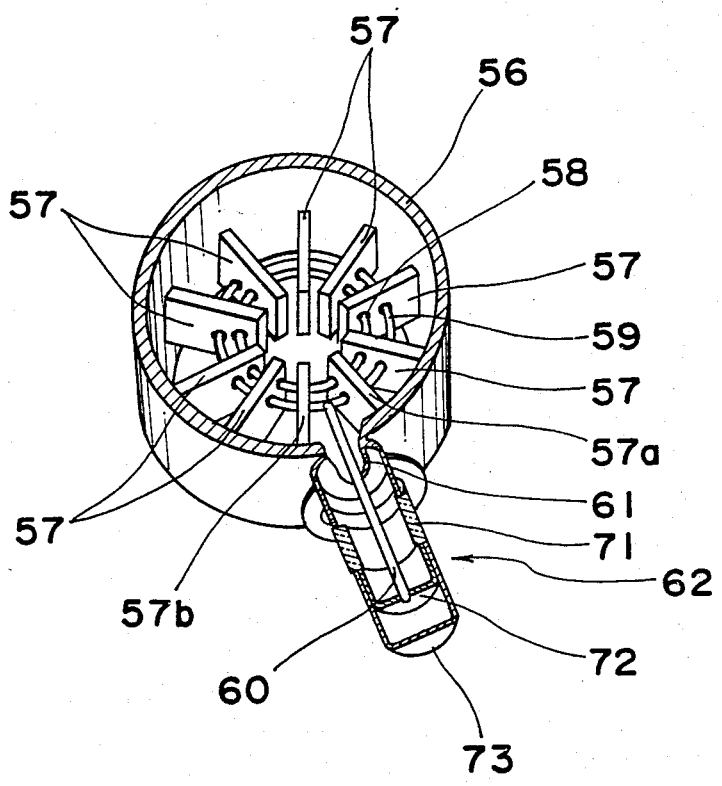
FIG. 6 is a perspective view, partly broken away, of an essential portion of the magnetron device of FIG. 5.

Referring now to FIGS. 5 and 6, there is shown an improved magnetron device according to one preferred embodiment of the present invention in which the problems in the conventional magnetron devices have been eliminated.

In FIGS. 5 and 6, the magnetron device of the present invention generally includes an anode cylinder 56, a plurality of vanes 57 radially disposed within the anode cylinder 56, a set of strap rings 58 and 59 having different diameters and disposed, through holes in the vanes, on the same plane generally at the central portion in the axial direction of the anode cylinder 56 so as to be alternately connected to every other one of said plurality of vanes 57, and an antenna lead 60 connected, at one end, to the strap ring 59 having the larger diameter, generally at portion of the ring intermediate neighboring ones (the vanes **57*a* and 57*b* in FIG. 6) of the plurality of vanes. The antenna lead 60 extends outwardly from the strap ring 59 in a direction perpendicular to the axis of the anode cylinder 56 through a coupling hole 61 formed in the side face of the anode cylinder 56 to an output antenna portion 62 as shown. There is also provided a cathode portion 63 comprising a spiral filament concentrically disposed at the central portion of the anode cylinder 56, with end plates 64 and 65 being mounted at opposite ends of said cathode portion 63 and respectively connected to support leads 66 and 67 extending in the axial direction of the anode cylinder 56. These support leads 66 and 67 are connected to a cathode stem 68 comprising ceramic material provided at one end face of the anode cylinder 56, for example, by silver-copper alloy brazing so as to be supported thereby. This cathode stem 68 is welded onto the end face of the anode cylinder 56 via a cathode side pipe 69 connected thereto, for example, by silver-copper alloy brazing. On the other end face of the anode cylinder 56, an exhaust pipe 70 is disposed and which has been cut and sealed as shown after the evacuation of the interior of the anode cylinder 56. The output antenna portion 62 comprises a ceramic side pipe 71, an antenna portion sealing pipe 72 and an antenna cap 73, with one end of the antenna lead 60 being brazed to the antenna portion sealing pipe 72. The magnetron device further includes pole pieces 74 and 75, ferrite permanent magnets 76 and 77, yokes 78 and 79 constituting the magnetic circuit, heat radiating fins 80 press-fitted to the anode cylinder 56, heat insulating plates 81 and 82 each provided between the anode cylinder 56 and the permanent magnets 76 and 77 for insulating the permanent magnets from the heat radiation radiating from the anode cylinder, a filter box 83, choke coils 84 and a through-capacitor 85**, etc.

The output antenna portion 62 is mounted on the side wall of the anode cylinder through a first metallic pipe 86 and a second metallic pipe 87. Each of these first and second metallic pipes 86 and 87 has a flange portion at respective ends thereof and connected to each other at the outer peripheries thereof, for example, by welding. At the side of the output antenna 62 adjacent the flange portion, a disc-like metallic plate 89 is provided so that the metallic gasket 88 is fixed and supported at the base portion of the output antenna 62 by the metallic plate 89 and the yoke 79.

In the arrangement according to the present invention, as described above, since the exhaust pipe is provided at a location different from that at which the output antenna portion is disposed, the antenna lead may be fixed in position before the exhaust process, whereby the undesirable deformation of the strap rings and vanes, etc. during the cutting and sealing process of the exhaust pipe can be eliminated.

It is to be noted here that the configuration of the antenna portion sealing pipe may be modified so as to provide a portion for supporting and fixing the antenna lead at the side of said pipe, and that the inner diameter of the exhaust pipe may be approximately the inner diameter of the cathode stem shown in the drawing for expediting evacuation of the interior of the anode cylinder.

As is clear from the foregoing description, according to the magnetron device of the present invention, the following effects can be produced.

(1) By the provision of the output antenna portion and the exhaust pipe at different portions of the anode cylinder, undesirable stress acting on the antenna lead during the cutting and sealing of the exhaust pipe may be eliminated, whereby the strap ring and vanes are free from deformation even when the antenna lead is directly connected to the strap ring.

(2) Since the inner diameter of the exhaust pipe can be selected more freely, it becomes possible to effect evacuation of the anode cylinder efficiently.

(3) Due to the disposition of the strap rings in the vanes through holes formed in said vanes, the electric field distribution in the space in which the antenna lead extends is particularly satisfactory, thus suppressing the unnecessary radiation propagating through the antenna lead.

(4) By providing the strap rings within the vanes, undesirable radiation towards the cathode stem side may be fully suppressed.

Although the present invention has been fully described by way of example with reference to the accompanying drawings, it is to be noted here that various changes and modifications will be apparent to those skilled in the art. Therefore, unless such changes and modifications depart from the scope of the present invention, they should be construed as included therein.

What is claimed is:

1. A magnetron comprising:

an anode cylinder defined by a cylindrical anode, a coupling hole extending through said cylindrical anode, and end faces defined, respectively, at opposite ends of said cylindrical anode;

a plurality of vanes extending radially within said cylindrical anode, each of said vanes having a plurality of through-holes extending therethrough;

a set of strap rings extending through said vanes in said through-holes thereof, respectively;

said strap rings having different diameters, and said strap rings alternately connected to every other one of said vanes in said through-holes;

an output antenna portion supported in the magnetron and extending in a direction normal to the central longitudinal axis of said cylindrical anode;

an antenna lead fixed within said output antenna portion and extending therefrom through the coupling hole of said anode cylinder, and said antenna lead having an end thereof directly connected to one of said strap rings at a location disposed approximately intermediate of two adjacent ones of said plurality of vanes; and and an exhaust pipe through which said anode cylinder has been evacuated, said exhaust pipe in communication with and extending from said anode cylinder at one of said end faces thereof, and spaced from said output antenna portion.

2. A magnetron as claimed in claim 1, and further comprising first and second metallic pipes disposed between and connecting said output antenna portion and said cylindrical anode, each of said metallic pipes having a flange portion at a respective end thereof, and the flange portions including a welded portion at which portions said metallic pipes are directly connected to one another at the flange portions.

3. A magnetron as claimed in claim 1, wherein said set of strap rings extend in a common plane disposed at a central portion of said vanes with respect to the longitudinal direction in which said cylindrical anode extends.

4. A magnetron as claimed in claim 1, wherein said antenna extends linearly from said end thereof.

* * * * *